US009850050B2

(12) United States Patent
Banerjee

(10) Patent No.: US 9,850,050 B2
(45) Date of Patent: Dec. 26, 2017

(54) ECO-FRIENDLY BEVERAGE CONTAINER HOLDER AND DISPENSER AND METHODS OF USE THEREOF

(71) Applicant: Banmali Banerjee, Edison, NJ (US)

(72) Inventor: Banmali Banerjee, Edison, NJ (US)

( * ) Notice: Subject to any disclaimer, the term of this patent is extended or adjusted under 35 U.S.C. 154(b) by 45 days.

(21) Appl. No.: 14/753,396

(22) Filed: Jun. 29, 2015

(65) Prior Publication Data

US 2016/0376079 A1 Dec. 29, 2016

(51) Int. Cl.

| | |
|---|---|
| ***B65D 65/00*** | (2006.01) |
| ***B65D 75/00*** | (2006.01) |
| ***B65D 71/36*** | (2006.01) |

(52) U.S. Cl.

CPC .... *B65D 71/36* (2013.01); *B65D 2571/00141* (2013.01); *B65D 2571/00635* (2013.01)

(58) Field of Classification Search

CPC ..... B65D 71/125; B65D 2571/00555; B65D 2571/00802; B65D 2571/00141; B65D 2571/00635; B65B 7/16

USPC ..... 206/427, 429, 431, 139, 140; 229/115

See application file for complete search history.

(56) References Cited

U.S. PATENT DOCUMENTS

| | | | | |
|---|---|---|---|---|
| 1,617,629 A * | 2/1927 | Gale | A45C 3/00 | 150/113 |
| 6,193,034 B1 * | 2/2001 | Fournier | A45C 7/0095 | 190/107 |
| 7,086,578 B2 * | 8/2006 | Tallevi | B65D 71/36 | 221/302 |
| 2005/0000840 A1 * | 1/2005 | Cahill | B65D 5/029 | 206/427 |

* cited by examiner

*Primary Examiner* — J. Gregory Pickett
*Assistant Examiner* — Rafael Ortiz
(74) *Attorney, Agent, or Firm* — Michael J. Feigin, Esq.; Feigin & Fridman

(57) ABSTRACT

A beverage container holding device and methods for the storage and dispensing of beverages. Embodiments of the beverage container holder include two spaced apart parallel and aligned triangular planes each with rounded vertices and with three equal side lengths between the rounded vertices. The corresponding sides of the triangular planes are connected by sides extending across the space between the triangular planes and perpendicular to them. One corner of the three sides extending in the spaced apart location comprises an articulated panel opening into an interior region of the beverage container holder. In some embodiments the parallel planes are trapezoidal in shape. Beverage containers are arranged, perpendicular to the triangular planes, in rows within the beverage container holder. The beverage container holder is filled by inserting beverage containers through the opened articulated panel and beverages are dispensed through the same portal. In some embodiments the beverage containers can be stacked.

5 Claims, 9 Drawing Sheets

ECO-FRIENDLY BEVERAGE CONTAINER HOLDER AND DISPENSER AND METHODS OF USE THEREOF

FIELD OF THE DISCLOSED TECHNOLOGY

The disclosed technology relates generally to eco-friendly storage and dispensing of containers and, more specifically, to eco-friendly triangular packages in which a section comprising one corner of the package is pivotably hinged, allowing access to, and the removal of, a beverage container.

BACKGROUND OF THE DISCLOSED TECHNOLOGY

Single serve beverages are often available in cylindrical containers of various diameters and compositions. Beverage containers include cans and bottles, composed of plastic, aluminum, or glass. Packaging of multiple beverage cans or bottles is often unwieldy, non-utilitarian and unaesthetic. For instance, soda cans are often packaged in rectangular cardboard cartons. A common means for accessing individual soda cans using such a cardboard carton is through an opening on the top surface of the carton created by removal of a section of the carton along the section's perforated borders. An inadequacy of this method is that access to the beverages is from the top of the carton, which is an awkward maneuver if the carton is positioned on a high shelf. Locating an opening on one of the narrowest sides of the rectangular carton is not feasible as the soda cans are stacked on their sides along the longer dimension of the carton. If an opening is located on the narrowest side of the carton, cans are likely to roll out of the carton.

Another common packaging method is the application of shrink wrap enclosing the containers in a side to side rectangular arrangement. Shrink wrapped beverages are typically accessed by creating or tearing an opening in the top or sides of the shrink wrap. A drawback of shrink wrap is that beverages are often removed randomly and not in an orderly fashion causing the remaining beverages to lack lateral support from the shrink wrap or other beverages resulting in beverages tipping over. Shrink wrapping beverages often leads to a sloppy, disorganized and unsightly display of remaining beverage containers as their numbers decline.

What is needed in the art is a beverage holding system that offers an organized, efficient, and aesthetically pleasing means of storing and dispensing beverage containers. At the same time, it should be eco-friendly.

SUMMARY OF THE DISCLOSED TECHNOLOGY

The device and method of the disclosed technology meets existing needs in a number of ways as the device provides an organized and aesthetically pleasing means of storing and dispensing beverage containers. First, the disclosed beverage container holding device comprises two spaced apart parallel and aligned triangular planes, each with rounded vertices and with three equal side lengths between the rounded vertices; three sides extending in the spaced-apart location between the parallel and aligned triangular planes connecting the parallel and aligned triangular planes to each other; wherein one corner of the three sides extending in the spaced-apart location comprises an articulated panel opening into an interior or exterior region of the beverage container holder. For the purposes of this specification, articulated means pivotable, bendable, hinged, jointed or otherwise rotatable along and around an axis. Triangular planar sides, triangular planes, triangular surfaces, and top and bottom surfaces are used interchangeably in this specification. Holder and device are also used interchangeably. Panel can also mean section. Hinged corner section and articulated corner panel are used interchangeably in this specification. Corner may include vertex or the curved area between the linear sides of said triangular planes. Aligned for the purposes of this specification, is defined as an arrangement in which the perimeters of two or more features coincide when viewed from a perspective where one feature is directly in front of the others. Aligned and coincide are used interchangeably in this specification.

In one embodiment of the device the articulated joint of the articulated panel may be comprised of a thinner layer of material comprising the adjacent side creating a weak axis along the joint, around which the panel pivots. In other embodiments the articulated joint may be comprised of a hinge wherein the hinge is further comprised of a continuous bar and sleeves or a plurality of bar and sleeves linearly arranged, fixedly and pivotably attaching the corner panel to the side of the device.

In another embodiment a latching mechanism can be placed at or near the unattached end of the articulated panel wherein the latching mechanism holds the panel closed, thus preventing the contents of the device from spilling or rolling out of the device. In further embodiments the latching mechanism can be comprised of a pivotable tab fixedly attached to the articulated corner panel, and said tab contains a peg which frictionally engages in a corresponding hole in a second part of the latching mechanism fixedly attached to the side of the holder. For the purposes of this specification latching mechanism may include, clasp, buckle, hook and loop connector, or clip.

Further embodiments include a device comprised of a rigid biodegradable and recyclable material, such as cardboard or wood. Also disclosed is a device that can be composed of rigid reusable material such as metal or plastic.

In another embodiment of the disclosed technology the triangular planes are equilateral triangles. The smallest of these equilateral triangles has a side length between two rounded vertices approximately equal to the diameter of a cylindrical beverage can/bottle and the distance between the two triangular planes is equal to the height of a beverage can/bottle. The smallest beverage container holder can hold 3 cans/bottles. In another embodiment the distance between the two parallel triangular planes can be increased to twice the height of a beverage container to accommodate six containers. Other embodiments can hold higher number of cans/bottles, for example, nine, twelve, . . . when the distance between the two parallel triangular planes is increased to three times or four times the diameter of the beverage container. In a further embodiment the top corner panel or the articulated panel can be made flat, thereby reducing the number of containers by one count—giving it a shape of a trapezoidal box. A trapezoidal box can be considered as a combination of three triangular boxes with rounded vertices and no articulated panels joined side-by-side and their adjacent faces eliminated. However, it should have a single articulated panel at one corner. The smallest size trapezoidal box can hold nine beverage containers, the next bigger size can hold eighteen containers, if the distance between the two parallel planes is made equal to two times the height of a beverage container.

Also disclosed is a method of storing and dispensing beverage containers comprising several steps including opening an articulated corner panel of a beverage container holder comprising two spaced apart parallel and aligned triangular planes, each with rounded vertices and with three equal side lengths between the rounded vertices; three sides extending in the spaced-apart location between the parallel and aligned triangular planes connecting the parallel and aligned triangular planes to each other; wherein one side (corner) of the three sides extending in the spaced apart location comprises the articulated corner panel opening into an interior region of the beverage container holder. Thereafter, placing beverage containers in the holder in a manner that they are oriented upright and perpendicular to the triangular planes of the holder. Once the desired number of beverage containers is placed in the holder, closing the articulated corner panel so that the unattached edge opposite the articulated edge of the corner panel, is substantially flush with the edge of the side of the holder. Then opening the articulated corner panel of the holder and removing a beverage container. Upright means the beverage container is oriented with the top of the beverage container above the bottom of the container.

In a further embodiment, the beverage containers are placed into the holder along the side opposite the articulated corner panel, creating a first row of the beverage containers each touching, or in close proximity, on three of its sides, to the holder's side or an adjacent beverage container; creating a second row of beverages by placing another row of beverage containers along the first row of beverage containers, each beverage container of the second row touching, or in close proximity, on three of its sides, to the holder's side or adjacent beverage containers, and the second row has one less beverage container than the first row; creating successive rows of beverage containers substantially similar to the method of creating the second row of beverages wherein each successive row of beverages has one less beverage container than the preceding row; continuing filling the holder until the last row is comprised of one beverage container that completely or substantially fills the space between the preceding row of beverages, sides of the holder and the articulated corner panel. Close proximity means adjacent, abutting, next to, or nearly touching. Preceding, for the purposes of this specification means immediately before, in space or in time. Although there are actually two sides or faces of a cylindrical container, top and bottom, and a lateral surface, for the purposes of this specification a beverage container is cylindrical and has four sides, which are tangential to its lateral surface and which create a square around the circumference of the beverage container. The ends of a beverage container constitute the top and bottom of a beverage container in this specification.

"Substantially" and "substantially shown," for the purposes of this specification, are defined as "at least 90%," or as otherwise indicated. "Identical" or "exactly," for the purposes of this specification, are defined as "within an acceptable tolerance level known in the art." Any device may "comprise" or "consist of" the devices mentioned there-in, as limited by the claims. Any element described may be one of "exactly" or "substantially" as described.

It should be understood that the use of "and/or" is defined inclusively such that the term "a and/or b" should be read to include the sets: "a and b," "a or b," "a," or "b."

DETAILED DESCRIPTION OF EMBODIMENTS OF THE DISCLOSED TECHNOLOGY

Embodiments of the beverage container holder include equilateral triangular and substantially planar top and bottom surfaces of equal dimensions. The edges of the top and bottom surfaces are aligned and connected along their entire perimeters by sides, perpendicular to the top and bottom surfaces, having a uniform height and forming a unitary and continuous structure. The vertices of the three-dimensional triangular structure are curved. One of the vertices comprises a closable panel which is pivotably attached along the entirety of its length between the top and bottom surfaces, forming an articulated corner panel.

Embodiments of the disclosed technology will become clearer in view of the following discussion of the figures.

Figure 1:
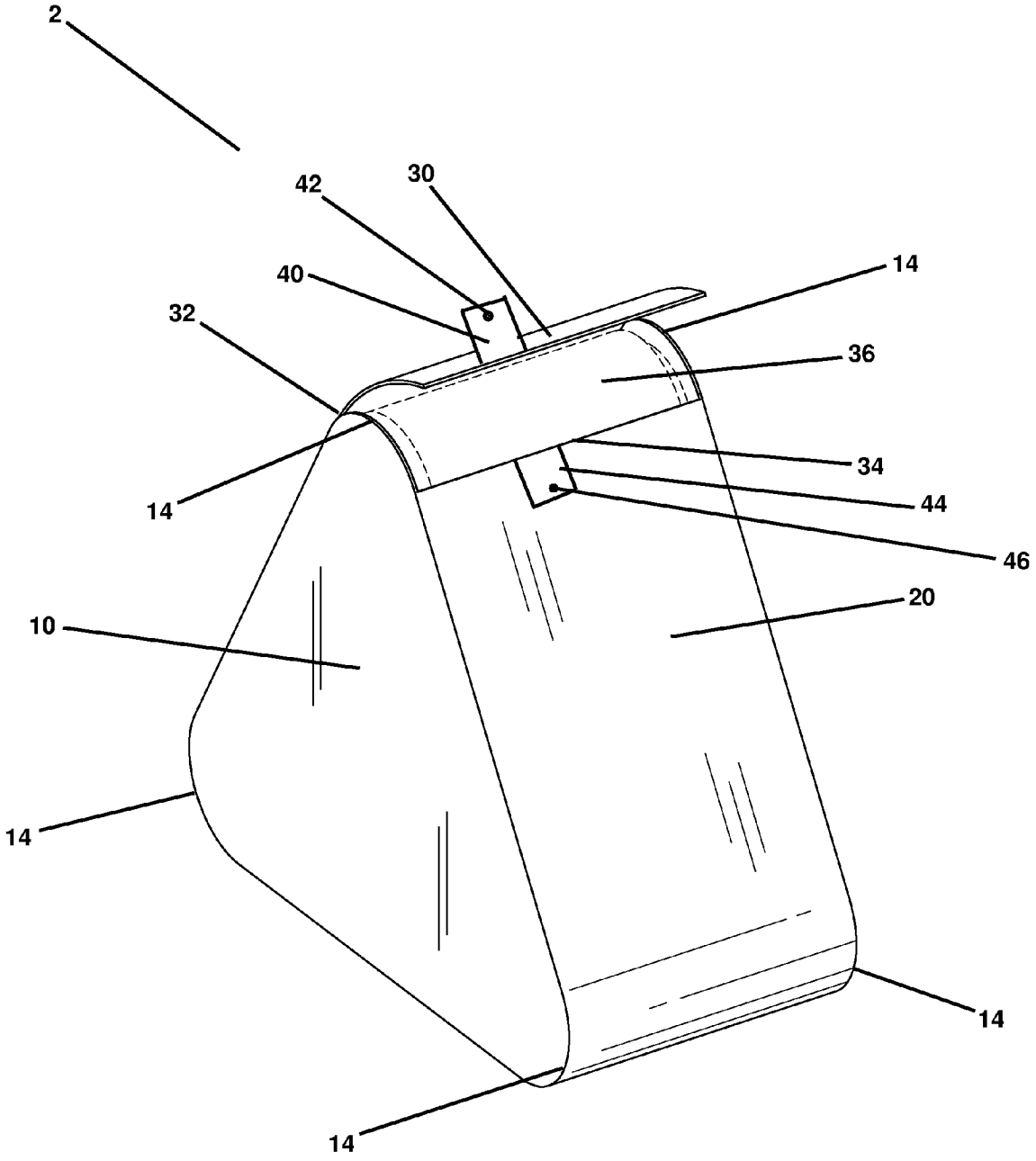
FIG. 1 shows a top and side perspective view of the triangular beverage container holder with an open hinged corner section and latching mechanism in an embodiment of the disclosed technology.

FIG. 1 shows a top and side perspective view of the triangular beverage container holder with an open hinged corner section and latching mechanism in an embodiment of the disclosed technology. The triangular beverage container holder 2 consists of a three-dimensional structure in which the top surface 10 and bottom surface 12 (better seen in FIG. 5) are shaped in the form of equilateral triangles of equal dimensions and are uniformly spaced apart. The perimeters of the two surfaces 10 and 12 are aligned and are fixedly connected by sides 20, perpendicular to the top and bottom surfaces 10/12, forming a unitary and continuous structure. The corners 14 of the three-dimensional triangular structure are curved. The height of the sides 20 is at least the height of the beverage containers intended to be placed in the holder 2. The holder 2 may be filled by opening its hinged corner section 30 and placing the beverage containers 36 into the holder 2 in a manner in which the beverage containers 36 are perpendicular to the top surface 10 of the holder 2 and parallel to the sides 20 of the holder 2. The hinged corner section 30 may then be fixedly closed by pushing the hinged corner section 30 in a manner that its unattached edge, opposite its hinged edge 32, is substantially flush with the edge 34 of the holder's 2 side 20 for transport or storage of the holder 2. In further embodiments, the articulated corner panel can be closed with a latching mechanism fixedly holding the articulated corner panel in a closed position. In additional embodiments, the latching mechanism is further comprised of a pivotable tab 40 on the articulated corner panel which contains a peg 42 that can frictionally engage in a corresponding hole 46 on a second part 44 of a latching mechanism.

Figure 2:
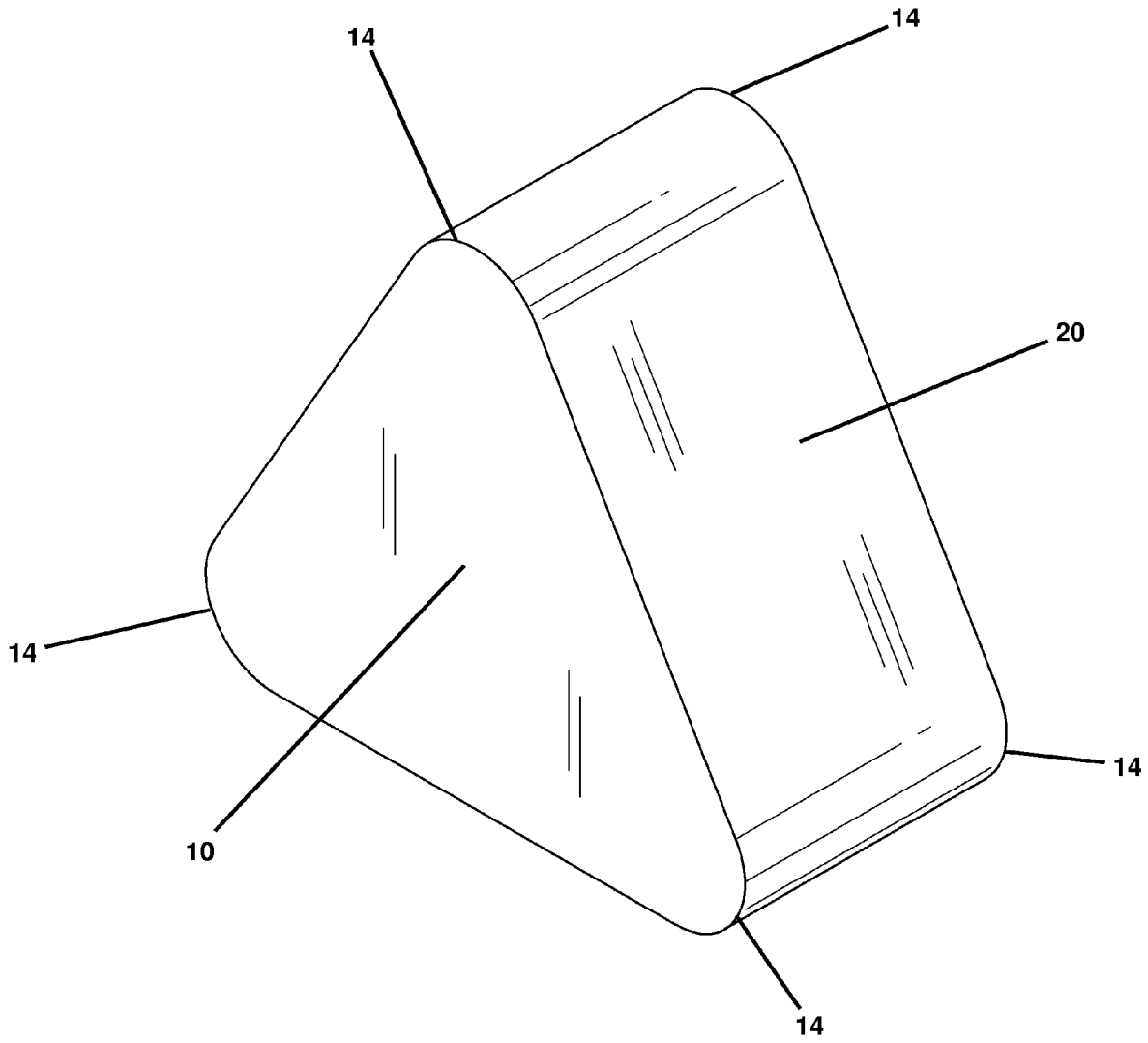
FIG. 2 shows the triangular beverage holder of FIG. 1 with the corner closed.

FIG. 2 shows a top and side perspective view of the triangular beverage holder with fixed corners.

Figure 3:
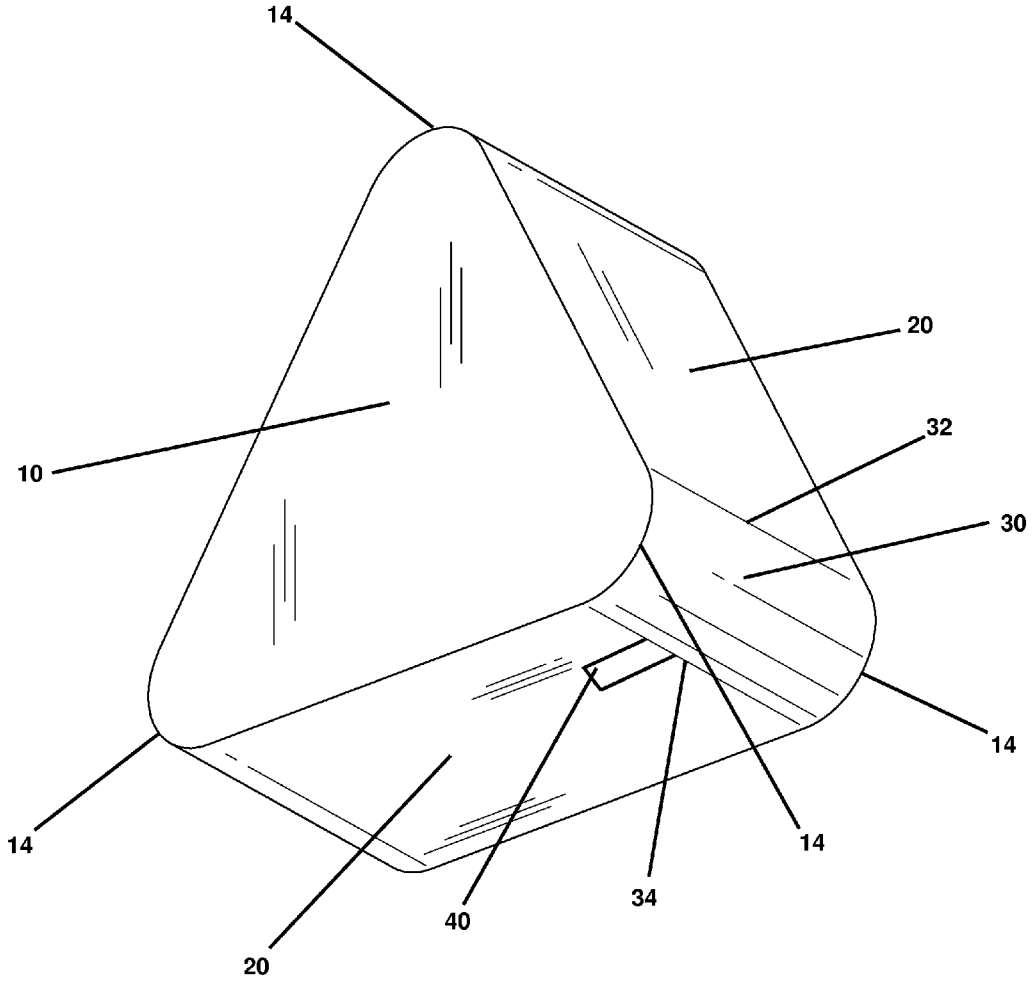
FIG. 3 shows a top and side perspective view of the triangular beverage holder of FIG. 2.

FIG. 3 shows a top and side perspective view of the triangular beverage holder with a pivotably hinged corner section. The hinged corner section 30 of the holder 2 is in its closed position with its unattached edge, opposite its hinged edge 32, substantially flushed with the edge 34 of the side 20. The tab 40 of the latching mechanism is in its closed position with its peg 42 engaged in the hole 46 of the second part of the latching mechanism 44, fixedly holding the articulated corner panel closed.

Figure 4:
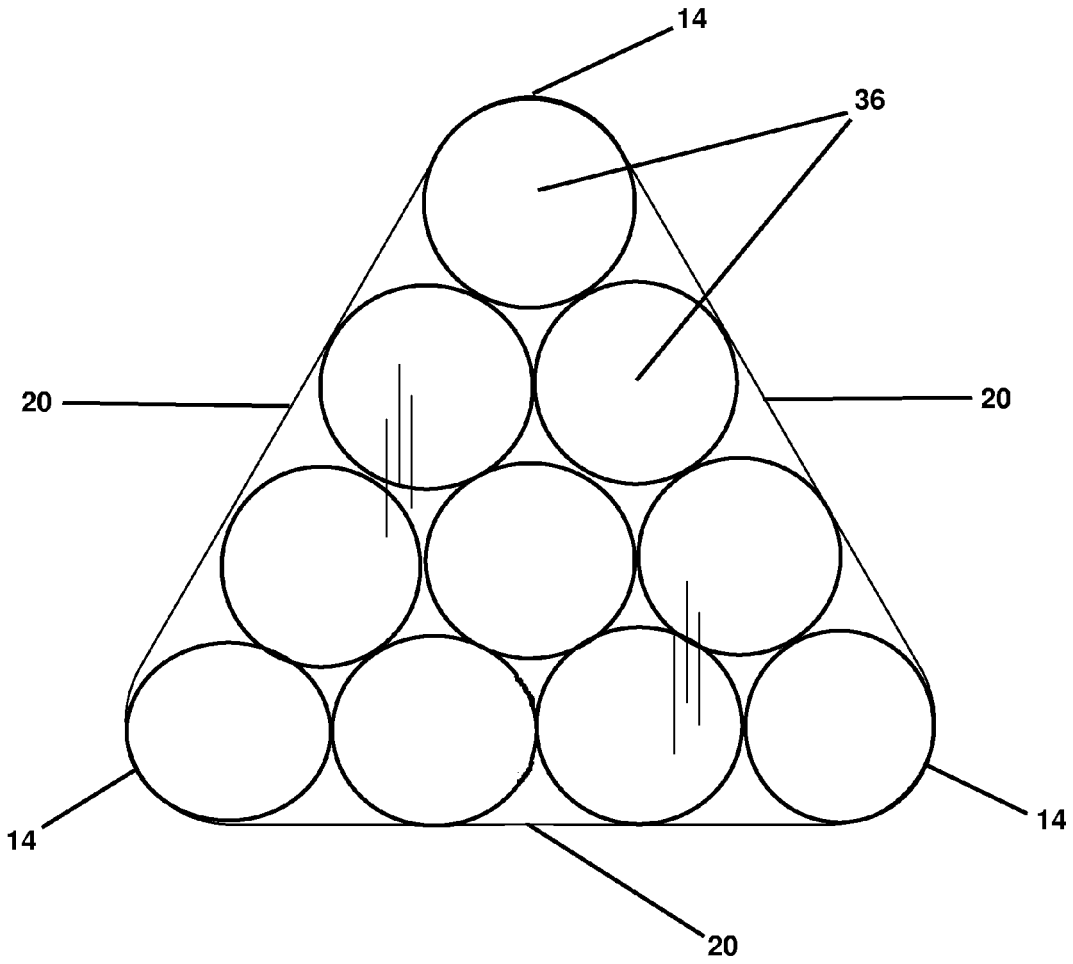
FIG. 4 shows a cross-section of the triangular beverage holder of FIGS. 1 through 3 with beverage containers therein.
Figure 5:
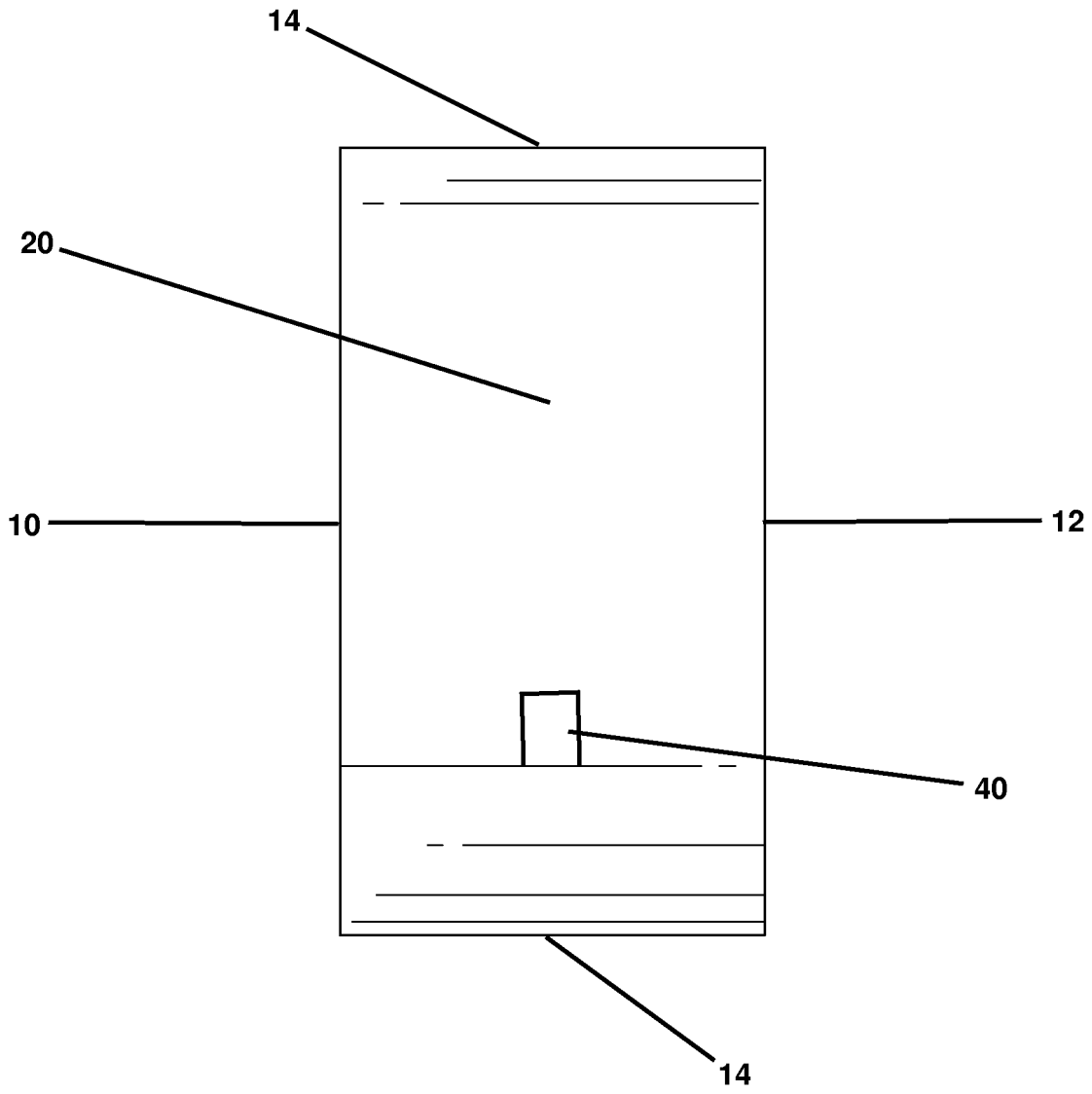
FIG. 5 shows a side elevation view of the triangular beverage holder of the preceding figures.
Figure 6:
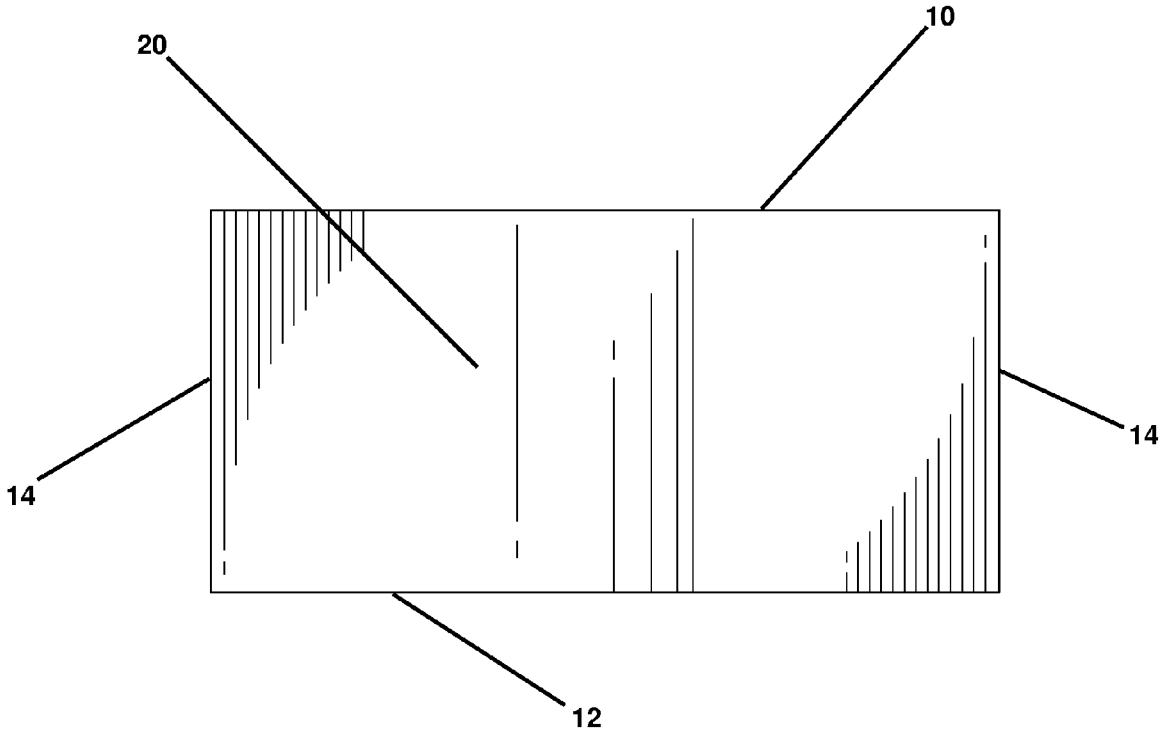
FIG. 6 shows a top side view depicting the three corners of the triangular beverage holder of the preceding figures.
Figure 7:
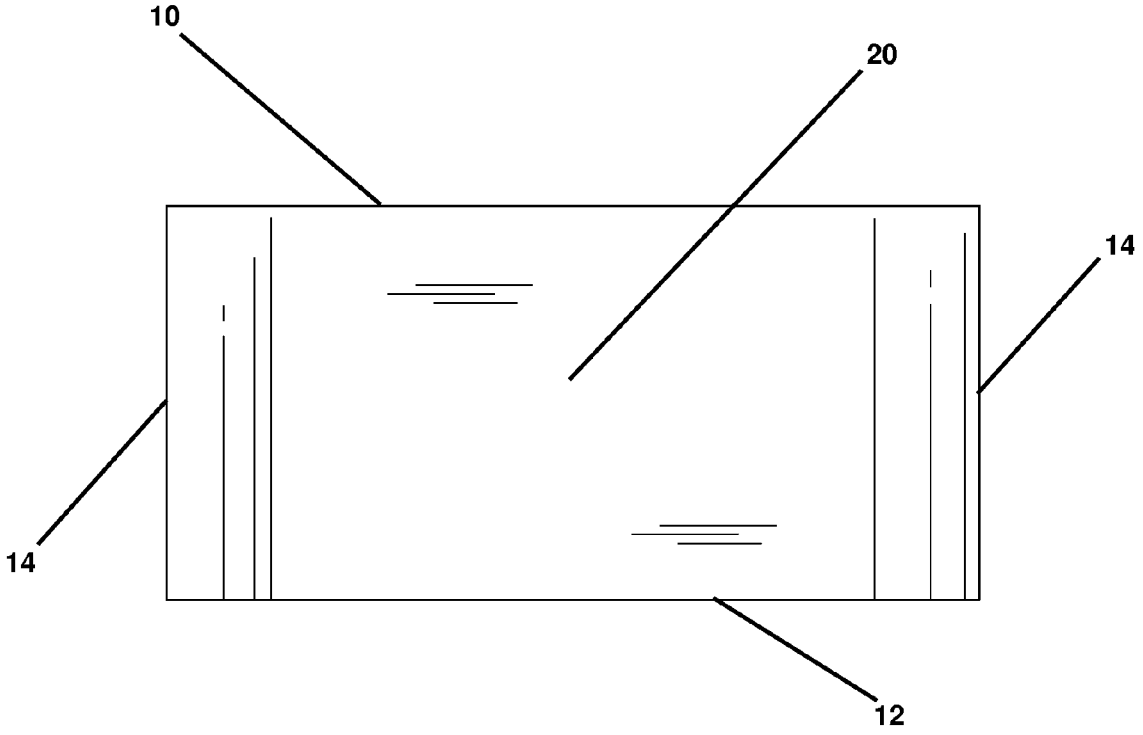
FIG. 7 shows a $t_{op}$ side view, depicting two corners, of the triangular beverage holder of the preceding figures.

FIG. 4 shows a cross-sectional top plan view of the triangular beverage holder and arrangement of beverage containers. FIG. 5 shows a side elevation view thereof. FIG. 6 shows a top side view, depicting the three corners, thereof. FIG. 7 shows a top side view, depicting two corners, thereof. The beverage containers 36 may be arranged vertically or upright and perpendicular to the top 10 and bottom 12 surfaces of the holder 2, so that the sides of each beverage container 36 are touching or in close proximity to the adjacent beverage containers 36 or the sides 20 of the holder 2.

Figure 8:
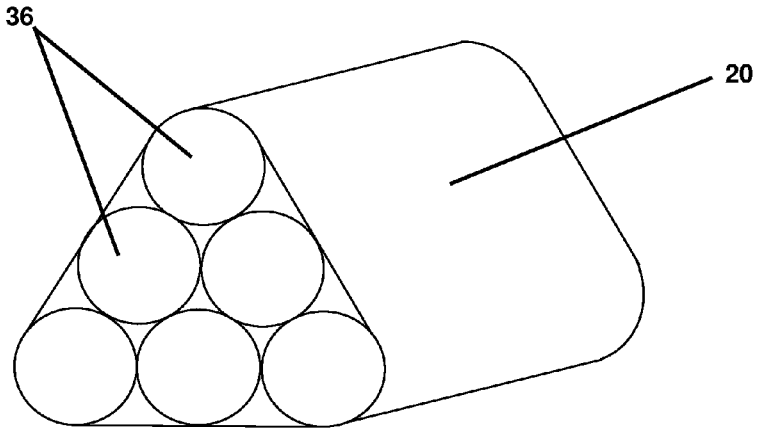
FIG. 8 shows a top and side perspective view of another embodiment where the distance between the top and bottom planes is twice the height of the beverage container.

FIG. 8 shows a top and side perspective view of another embodiment where the distance between the top and bottom planes is twice the height of the beverage container.

Figure 9:
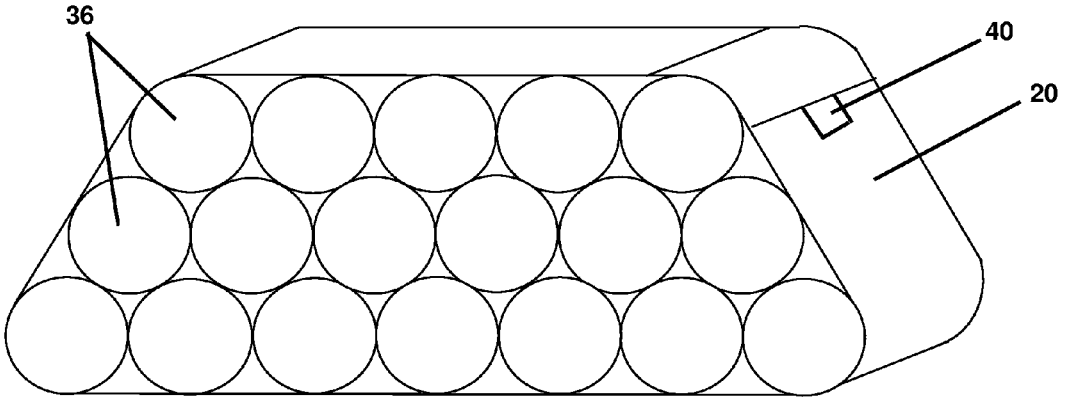
FIG. 9 shows a top and side perspective view of another embodiment, a trapezoidal shapes that can hold eighteen beverage containers.

FIG. 9 shows a top and side perspective view of another embodiment, a trapezoidal shape that can hold eighteen beverage containers. A similar embodiment can hold thirty six beverage containers, if the distance between the top and bottom planes is twice the height of the beverage container. FIG. 9 depicts the articulated corner panel on one of the corners between the shorter of the two parallel sides and a non parallel side, however, articulated corner panel may be located on any of the four corners of the trapezoidal beverage container holder.

Figure 10:
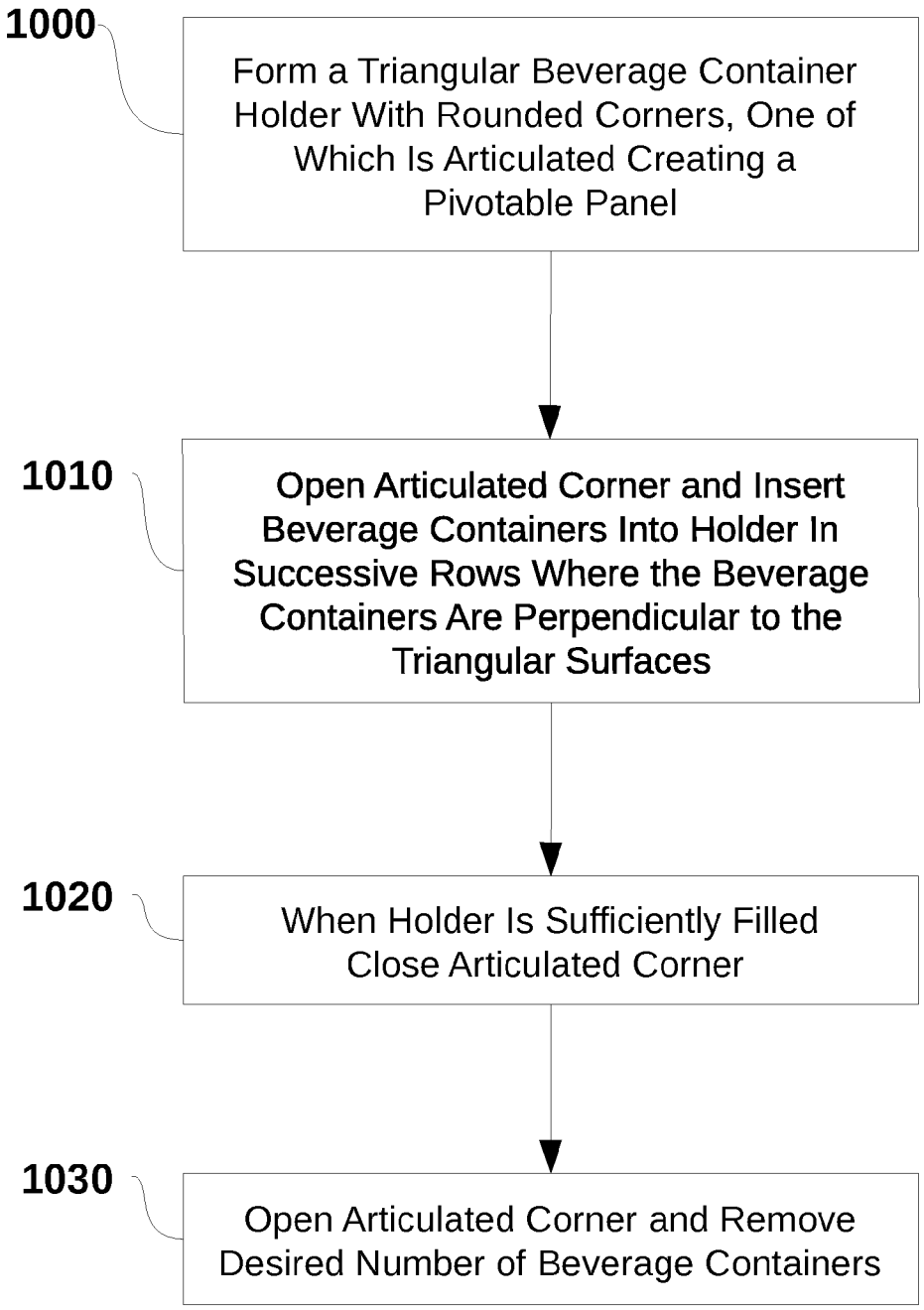
FIG. 10 is a flowchart of a method of using a triangular beverage holder.

FIG. 10 is a flowchart of a method of using a triangular beverage holder. In the first step a triangular beverage container holder with rounded corners, one of which is articulated, creating a pivotable panel, is formed 1000. The articulated corner is opened and beverage containers are inserted into the holder in successive rows, where the beverage containers are perpendicular to the triangular surfaces 1010. When the holder is sufficiently filled, the articulated corner is closed 1020. The articulated corner is then opened and the desired number of beverage containers is removed 1030.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects, only as illustrative and not restrictive. All changes that come within the meaning and range of equivalence of the claims, are to be embraced within their scope. Combinations of any of the methods and apparatuses described hereinabove are also contemplated and within the scope of the invention.

The advantages of the disclosed technology and devices are derived from the curved or rounded corners of the said devices as compared to the existing rectangular beverage holders, in that the savings result from the cut out materials of the vertices and may be in terms of millions of trees every year. Since the consumption of beverages, for example, coke, runs into billions of cans every day (estimated 1.7 billion cans/day) in the world, the disclosed triangular beverage container holder with curved cornerscan save at least 15% of packaging materials, which amounts to a saving of at least 1 million trees/year. The following calculations show the scope and amount of savings resulting from the use of the disclosed design.

Existing Rectangular Soda Can Box (12-can) with a length, 1=15 inches, width, w=5 inches, and height, h=4.75 inches, Volume=(l) (w) (h)=(15)(5)(4.75)=356.25 cu. in.

Surface Area (SA)=2(lw+wh+hl)=2(15×4.75+15×5+5×4.75)=340 sq. in.

New Curved Triangular Beverage Holder (12-can)

Considering one vertex of one of the parallel planes, which is an equilateral triangle, named ABC when its vertex B is not cut or curved, but marked for cutting: the area between the curved, circular mark and the corner is the actual saving of paperboard from one corner of one parallel plane. Now we join any two sides of the equilateral triangle with two radii of the circle/circular mark at one corner that represents the cross section of a beverage can placed in that corner. The radii FD and FE and the sides meet perpendicularly and the sides become tangent to the circle at D and E, respectively. When we join the center F of the circle with the vertex B of the equilateral triangle by a line segment FB, then this line segment, FB, the two sides, AB and BC, and the two radii, FD and FE, form two congruent 30-60-90 degree triangles, BEF and BDF. The total saving from one curved triangular box is calculated based on these two congruent triangles as below.

Surface Area of the New Curved Triangular box (using the 30-60-90 triangle)

=area of 2 curved triangles+lateral area

=2(area of equilateral triangle ABC−savings on 3 corners)+(length around) (height)

$=2[(\sqrt{3}/4)(\text{side})^2-3(\text{area of DBEF}-(\text{sector DGEF})]+(5+5+5+2\pi(1.25))(9.5)$ $=2[(\sqrt{3}/4)(5+2(1.25\sqrt{3}))^2-3(2 \text{ times the area of triangle BEF}-(120°/360°)(\pi)(1.25)^2)]+(15+2\pi(1.25))(9.5)$ $=2[37.69430571-3(2(1/2)(1.25)(1.25\sqrt{3})-(120/360)(\pi)(1.25)^2)]+217.1128255$ $=2[37.69430571-3(2.706329387-1.63246174)]+217.1128255$ $=2[37.69430571-3(1.070083213)]+217.1128255$ $=2[37.69430571-3.210249639]+217.1128255$ $=2[34.48405607]+217.1128255$ =286.0809377 square inches.

Volume of the New Curved Triangular box

=(SA of one face) (height)

=(34.48405607)(9.5)

=327.5985327 cubic inches

Percent saving in volume as compared to a rectangular box

=(new−old)/((old)(100))

=(327.5985327−356.25)/((356.25)(100))

=a saving in volume of 8.04%

Saving in SA in a curved triangular box as compared to a rectangular box

=340−286.0809377=53.9190623 sq. in.

Saving in SA in the curved triangular box/year

=(53.9190623 sq. in./box)(1700000000 cans/12 cans/box/day)(365 days)

=2,788,806,484,600 sq. in.

or a saving of 2788.8 billion square inches of paperboard/year

Percent saving in SA
=(new−old)/(old)(100)
=(286.0809377−340)/((340)(100))
=15.8585478%
or a saving in SA of 15.86%.

Number of equivalent new boxes
=53.9190623/340
=0.158585478 new boxes/existing box Savings of equivalent trees (estimated 1375 boxes=1 tree)
=0.158585478/1375
=0.000115335 trees/box Savings of trees/day (assuming 20% of 1.7 billion cans per day packed in cardboard boxes and 12 cans/box)
=(0.000115335)(0.2)(1900000000/12)
=3652.271615 trees/day Savings of trees/year
=(3652.271615)(365)
=1333079.139 trees/year
or a saving of 1.333 million trees/year Advantages and Disadvantages of the Disclosed Technology Advantages 1. The existing 12-can Coke box weighs 88.1 grams. Total weight of Coke can boxes/year=2.50 million tons (assuming 20% of 1.7 billion cans per year packed in cardboard boxes). The total production of paperboard for packaging purposes is 300 million tons/year (http://www.tappi.org/pa-peru/all_about_paper/faq.htm). About 15.86% saving on paperboard=300×15.86%=0.48 million tons of paperboard/year. The new design can be extended to redesign many other product packages.
2. Paper and paper products made only from 1 ton of recycled paper (like the cut corner pieces from the curved triangular box as mentioned in #1 above) instead of trees will save "17 trees, and 7000 gallons of water, 84 gallons of oil, and 4,100 kilowatt-hours of electricity—enough to power the average American home for six months." (http://www.epa.gov/re-gion3/beyondtranslation/2013BTF/SessionB-Beautification/Michelle-Feldman.pdf)
3. There will be a saving of 1.3 million trees/year due to the savings in paperboard if the 12-can curved triangular box is used instead of the existing 12-can rectangular box.
4. If we cut less number of trees, then those live trees can hold natural water from rain. Water conservation in this manner may partially help solve the water crisis that the world is going to face by 2020.
5. Reduction in paperboard as mentioned in #1 above (15.86%) will have the corresponding savings on printing cost of beverage can boxes.
6. Reduction in paperboard as mentioned in #1 above (15.86%) will have the corresponding savings in storage and handling costs.
7. More trees can absorb more carbon dioxide and save the ozone layer that protects us from the Ultra Violet rays.
8. More trees can save energy, improve storm water quality, reduce pavement maintenance, and improve quality of life. (http://www.epa.gov/heatisland/mitigation/trees.htm)

Disadvantages

1. Since the triangular box has curved corners, it may require initial training on handling and storage.
2. The die cutters required for making boxes may have to be redesigned due to the curved corners of the triangular box. However, the savings due to the disclosed technology will far outweigh the cost of redesigning the die cutters.

The invention claimed is:

1. A method of storing and retrieving beverage containers, the method comprising:

(a) providing a beverage container holder comprising:

first and second curved triangular planar sides, said first and second triangular planar sides being parallel and aligned, and being spaced apart from each other, each of said first and second triangular planar sides having rounded vertices and three side lengths between said rounded vertices;

three sides extending between said first and second parallel and aligned triangular planes connecting said parallel and aligned triangular planes to each other, wherein each of said three sides is fixedly attached at one edge thereof to said first triangular planar side and at an opposing edge thereof to said second triangular planar side, wherein said three sides each further comprise at least one curved corner each corresponding to one of said rounded vertices of said curved triangular planar sides;

wherein one curved region between two of said three sides, extending in a spaced-apart location between said first and second triangular planar sides, comprises an articulated panel opening into an interior region or outwardly to an exterior region of said beverage container holder, (b) opening said articulated panel of said beverage container holder;

(c) placing elongated beverage containers in said beverage container holder in a manner such that a most elongated side of each said beverage container is oriented perpendicularly to each said curved triangular plane of said holder, wherein said beverage containers are inserted into said holder via a portal formed by said opening said articulated panel;

(d) closing said articulated panel by moving or causing to move said articulated panel until at least a portion of a side of said articulated panel substantially engages at least part of at least one of said side lengths of each said curved triangular planar side; and opening said articulated panel of said holder and removing a beverage container.

2. The method of claim 1, wherein said beverage container holder further comprises a latching mechanism on the unattached end of said articulated panel wherein said latching mechanism holds the panel closed, and wherein after the desired number of beverage containers is removed, the articulated panel is closed by engaging said latching mechanism.

3. The method of claim 1, wherein said beverage containers are arranged in said holder in a pyramid structure.

4. The method of claim 1, wherein the beverage containers are placed into said holder along the side opposite said articulated panel, creating a first row of said beverage containers each touching, or being in close proximity, on three of its sides, to the holder's side or an adjacent beverage container; creating a second row of beverages by placing another row of beverage containers along said first row of beverage containers, each beverage container of said second row touching, or in close proximity, on three of its sides, to the holder's side or adjacent beverage containers and said second row has one less beverage container than the first row; creating successive rows of beverage containers substantially similar to the method of creating the second row of beverages, wherein each successive row of beverages has one less beverage container than the preceding row; continuing filling said holder until the last row is comprised of one beverage container that completely or substantially fills the space between the preceding row of beverages, sides of said holder and said articulated panel.

5. The method of claim 1, wherein said— placing elongated beverage containers comprises placing said elongated beverage containers in said holder in a manner such that two layers or levels of beverage containers are formed and the end of a beverage container in one layer is contiguous to the end of a beverage container in the other layer.

* * * * *